US011118759B1

(12) United States Patent
Lan et al.

(10) Patent No.: US 11,118,759 B1
(45) Date of Patent: Sep. 14, 2021

(54) REFLEX LAMP HOUSING AND MODULAR LAMP

(71) Applicant: SHENZHEN GUANKE TECHNOLOGIES CO., LTD, Shenzhen (CN)

(72) Inventors: Qing Lan, Shenzhen (CN); Ligen Liu, Shenzhen (CN); Shoubao Chen, Shenzhen (CN); Tianlong Dai, Shenzhen (CN); Buyuan Peng, Shenzhen (CN)

(73) Assignee: SHENZHEN GUANKE TECHNOLOGIES CO., LTD, Shenzhen (CN)

( * ) Notice: Subject to any disclaimer, the term of this patent is extended or adjusted under 35 U.S.C. 154(b) by 0 days.

(21) Appl. No.: 16/897,669

(22) Filed: Jun. 10, 2020

(30) Foreign Application Priority Data

Apr. 24, 2020 (CN) ..... 202020645392.8

(51) Int. Cl.

| | |
|---|---|
| ***F21V 15/00*** | (2015.01) |
| ***F21V 15/01*** | (2006.01) |
| ***F21V 23/00*** | (2015.01) |
| ***F21K 9/232*** | (2016.01) |
| ***F21V 23/06*** | (2006.01) |
| ***F21K 9/235*** | (2016.01) |
| *F21Y 103/00* | (2016.01) |
| *F21Y 115/10* | (2016.01) |

(52) U.S. Cl.
CPC ..... *F21V 15/01* (2013.01); *F21K 9/232* (2016.08); *F21K 9/235* (2016.08); *F21V 23/003* (2013.01); *F21V 23/06* (2013.01); *F21Y 2103/00* (2013.01); *F21Y 2115/10* (2016.08)

(58) Field of Classification Search
CPC ..... F21V 15/01; F21V 23/003; F21V 23/06; F21K 9/23; F21K 9/232; F21K 9/235; F21K 9/237; F21K 9/27; F21K 9/275; F21K 9/68; F21Y 2103/00
See application file for complete search history.

(56) References Cited

U.S. PATENT DOCUMENTS

| | | | | |
|---|---|---|---|---|
| 2011/0267821 | A1* | 11/2011 | Van De Ven | F21K 9/232 362/249.02 |
| 2013/0070458 | A1* | 3/2013 | Shi | F21K 9/232 362/235 |
| 2017/0268765 | A1* | 9/2017 | Luo | F21K 9/232 |
| 2018/0187846 | A1* | 7/2018 | Cohen | F21K 9/237 |
| 2019/0226644 | A1* | 7/2019 | Van Bommel | F21K 9/232 |

* cited by examiner

*Primary Examiner* — Y M. Quach Lee
(74) *Attorney, Agent, or Firm* — Maier & Maier, PLLC

(57) ABSTRACT

A reflex lamp housing and modular lamp, including: a base, a reflex lamp housing and at least one protective lantern ring; a reflex lamp housing provided on the base, periphery of the reflex lamp housing provided with several containing grooves, the inner wall of each of the containing grooves provided as a reflective panel, the containing grooves used for containing luminous module connecting to the base electrically; the protective lantern ring is provided around the reflex lamp housing, the protective lantern ring and the lamp cap are provided at intervals, forming a light access area. The reflex lamp housing is of enhanced structural strength and improves the lighting effect.

13 Claims, 6 Drawing Sheets

REFLEX LAMP HOUSING AND MODULAR LAMP

CROSS-REFERENCE TO RELATED APPLICATIONS

This application claims the priority of Chinese Patent Application No. 2020206453928 filed on Apr. 24, 2020, the disclosure of which is incorporated herein by reference.

FIELD

The embodiments relate to the field of lighting equipment, particularly to reflex lamp housing and a modular lamp using the reflex lamp housing.

BACKGROUND

In daily applications, bulbs or light bars are used for lighting. Commonly, rays of light generated by bulbs or light bars radiate to all directions, so the illumination is weak. A reflector can be provided on the back of the bulb or light bar to gather rays of light, and then rays of light can radiate towards the side of the reflector, by which rays of light can be improved locally. However, the reflector is usually of a panel structure, so the reflective material is low in structural strength and easy to deform, affecting the reflection effect.

The foregoing content is only used for assisting in understanding the technical scheme of the invention, but not mean the acknowledgement of that the above content is a prior art.

SUMMARY

A main purpose of the embodiments is to provide a reflex lamp housing to enhance the structural strength of the reflex lamp housing and improve the lighting effect.

To achieve the afore the objective, the reflex lamp housing includes:

a base;

a reflex lamp housing provided on the base, periphery of the reflex lamp housing provided with several containing grooves, the inner wall of each of the containing grooves provided as a reflective panel, the containing grooves used for containing luminous module connecting to the base electrically; and at least one protective lantern ring provided around the reflex lamp housing and provided at intervals with the base to form a light access area.

In one embodiment, the reflex lamp housing also comprises several the protective lantern rings provided around the reflex lamp housing, and two neighboring the protective lantern rings are provided at intervals.

In one embodiment, the protective lantern ring and the reflex lamp housing are connected through welding.

In one embodiment, the inner wall of the containing grooves is in a cambered shape;

and/or, the periphery of the reflex lamp housing are provided with three the containing grooves;

and/or, the reflex lamp housing is made of aluminum alloy;

and/or, the protective lantern ring is made of aluminum alloy;

and/or, the reflex lamp housing and/or the protective lantern ring are/is of a sleeve structure.

In one embodiment, the reflex lamp housing also comprises a support plate provided on one end of the reflex lamp housing away from the base and provided with a locating hole corresponding to each of the containing grooves;

the inner wall of the locating holes and the outer wall of luminous module are against each other.

In one embodiment, the reflex lamp housing also comprises several elastic washers, and each of the elastic washers is provided on one the locating hole.

In one embodiment, the base comprises:

lamp cap provided with installation cavities and several offsetting holes connecting the installation cavity, wherein, each of the offsetting holes is provided corresponding to each of the containing grooves; and Circuit components provided in the installation cavity and connecting to the lamp cap, wherein, the circuit components are provided with a connection end corresponding to each of the offsetting holes and the connection end is used for electric connection with luminous module.

In one embodiment, the lamp cap comprises:

a bottom shell provided with tanks and mounting openings connecting the bottom wall of the tank;

an upper cover connecting to the bottom shell, covering the notch of the tank to form the installation cavity in the way of enclosure, and provided with several the offsetting holes; and input end connecting to the bottom shell, sealing the mounting opening, and connecting to the circuit components electrically.

An embodiment also provides a modular lamp, which includes several luminous modules and the reflex lamp housings of any of claims in several luminous modules are provided in several containing grooves of the reflex lamp housing, and several the luminous modules connect to the base of the reflex lamp housing electrically.

In one embodiment, the luminous module is UV fluorescent tube or LED light bar.

The embodiments provide the reflex lamp housing on the base, the periphery of the reflex lamp housing is provided with several containing grooves, and the inner wall of each of the containing grooves is provided as a reflective panel; wherein, several the luminous modules are provided on the base, connect to the base electrically and are contained in several containing grooves, the base is taken as the connection base for connecting the power supply to supply power for several the luminous modules which radiates in several containing grooves. Understandably, by taking the base as the connection base and providing reflex lamp housing on the base, the reflex lamp housing is above the surface of the base, the luminous modules are away from the base, avoiding rays of light being impeded by the base, and rays of light are gathered with the reflex lamp housing to improve the efficiency of illumination; in another aspect, rays of light are generated with several luminous module to enhance illumination of rays of light within the unit time and enhance the coverage of rays of light. In yet another aspect, at least one protective lantern ring is provided around the reflex lamp housing, connection of the protective lantern ring and the reflex lamp housing improves the structural strength between the protective lantern ring and the reflex lamp housing, and the protective lantern ring and the luminous modules are provided at intervals, which protects the luminous modules to some extent, protects the luminous modules from collision of external articles and improves the service life of the reflex lamp housing; in yet another aspect, providing the protective lantern rings around a reflex lamp housing avoids application of other protective housing structures outside the reflex lamp housing, effectively reducing the volume of the reflex lamp housing.

BRIEF DESCRIPTION OF THE DRAWINGS

To better describe the technical schemes, a brief introduction of drawings to be used in the descriptions of the embodiment or prior art is made hereby. The drawings described below are only several embodiments. For common technicians in this field, they can obtain other drawings based on these structures shown in the drawings without making additional creative endeavors.

Figure 1:
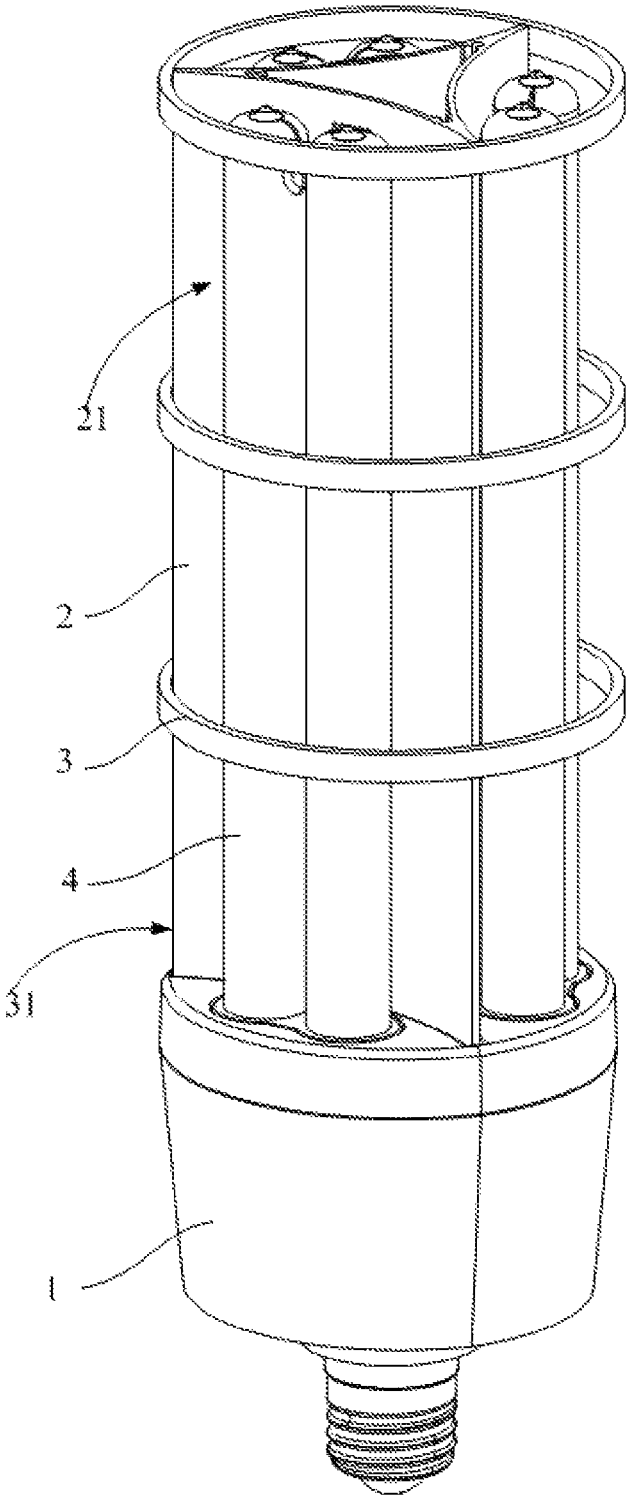
FIG. 1 is a schematic diagram showing the structure of an embodiment of reflex lamp housing.

The implementation, functional characteristics and advantages of the embodiments will be further illustrated hereinafter in conjunction with the embodiments and accompanying drawings.

DETAILED DESCRIPTION

A clear and complete description of the technical schemes combined with the drawings in embodiments, the embodiments clearly and completely describe the technical programs. Only some embodiments (instead of all the embodiments) are described here. Based on the embodiment, all other embodiments acquired by the common technicians in this field without creative work, shall be in the protection scope of this utility model.

It should be noted that, if there is a directional indication (upper, lower, left, right, front, and rear, etc.) in the embodiment of the utility model, the directional indication is only used to explain the relative positional relationship, motion condition, etc. between the components in a particular position (as shown in the drawing), and if the particular attitude is changed, the directional indication is changed accordingly.

In addition, if there are descriptions relating to "first", "second" and the like in embodiments of the utility model, such descriptions of "first", "second" and the like are for descriptive purposes only and are not to be construed as indicating or implying their relative importance or implying an indication of the number of indicated technical features. As such, a feature that defines as "first", "second" may explicitly or implicitly include at least one of that features. In addition, the "and/or" as stated in the whole text should be understood as there are three paralleled schemes where scheme A, or scheme B or scheme A and scheme B can be met at the same time (taking "A and/or B as an example"). In addition, the technical schemes of embodiments may be combined with each other, but must be available for common technicians in this field, and when the combination of the technical scheme is contradictory or impossible, it should be considered that the combination of the technical scheme does not exist and not fall within the scope of the utility model.

Figure 2:
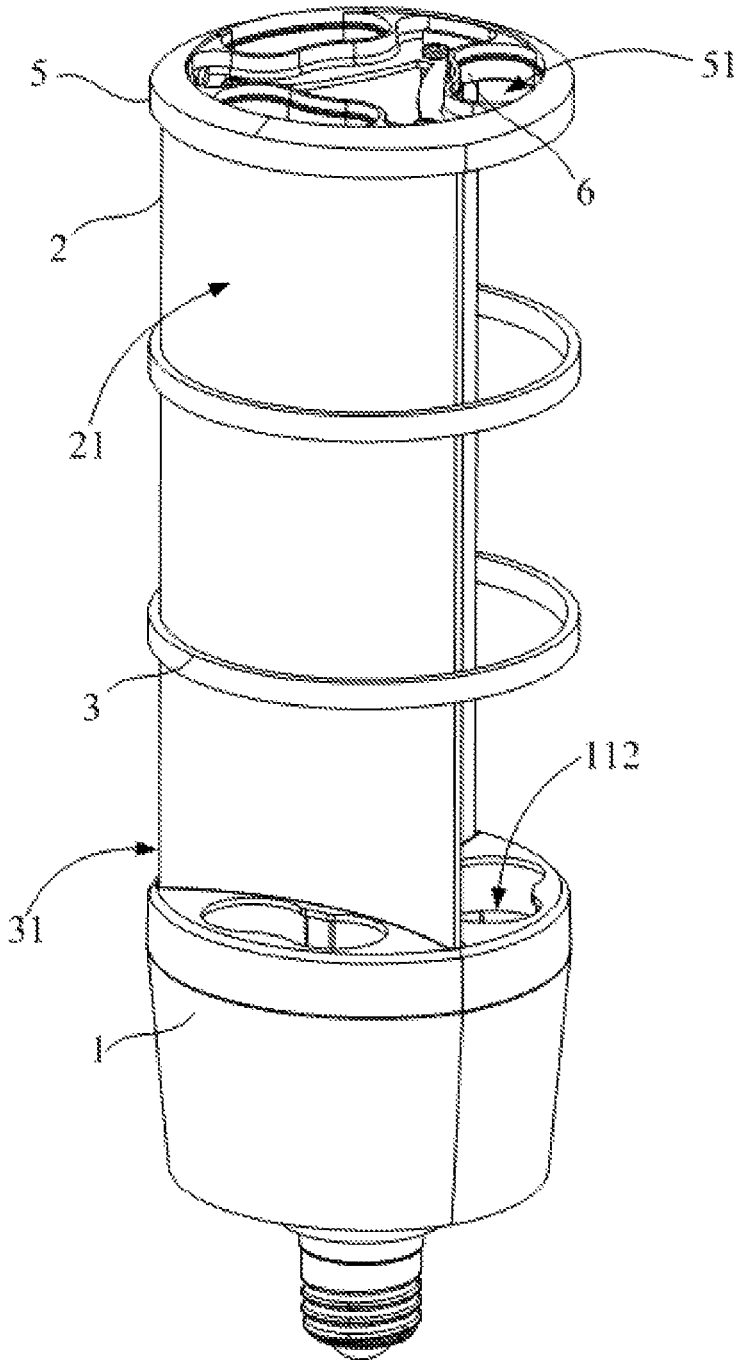
FIG. 2 is a schematic diagram showing the structure of another embodiment of reflex lamp housing in FIG. 1.
Figure 3:
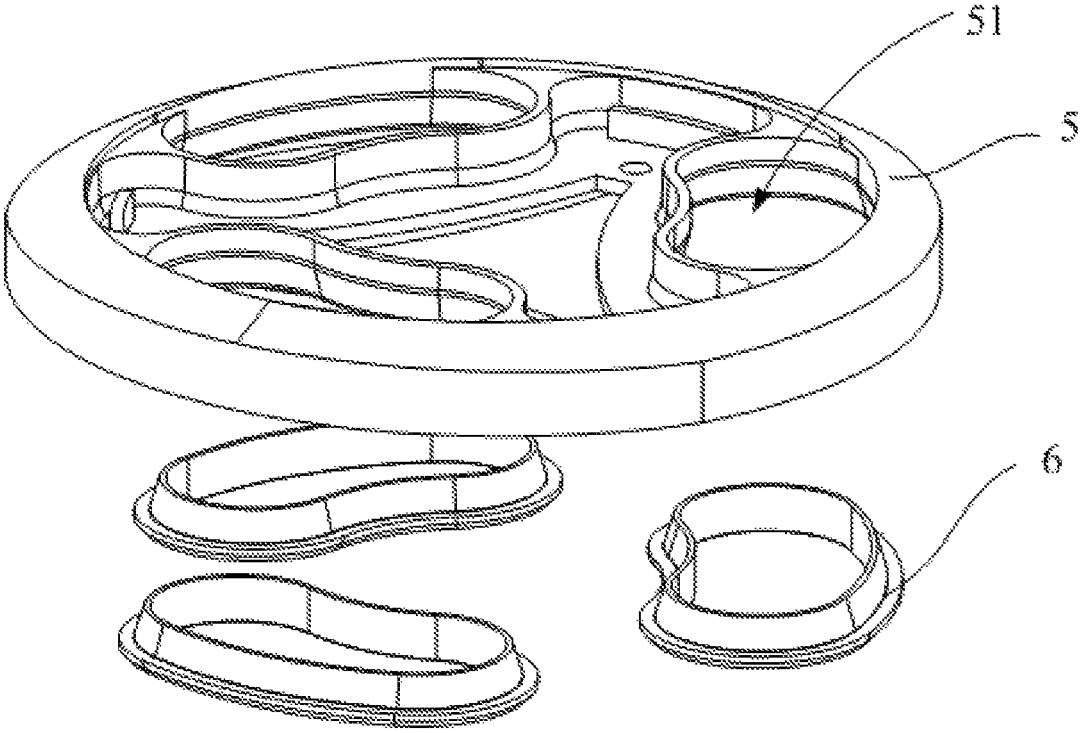
FIG. 3 is a schematic diagram showing the structure of support plate in FIG. 2.
Figure 4:
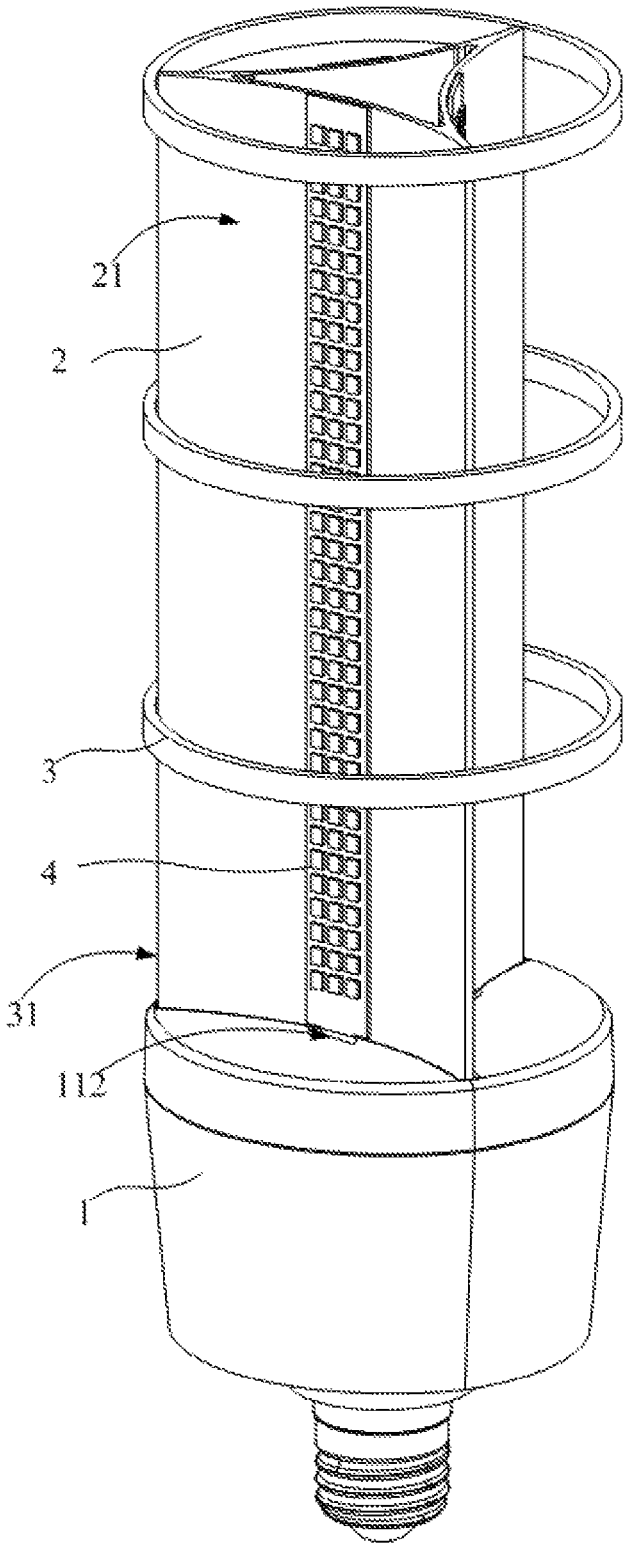
FIG. 4 is a schematic diagram showing the structure of another embodiment of reflex lamp housing in FIG. 1.
Figure 5:
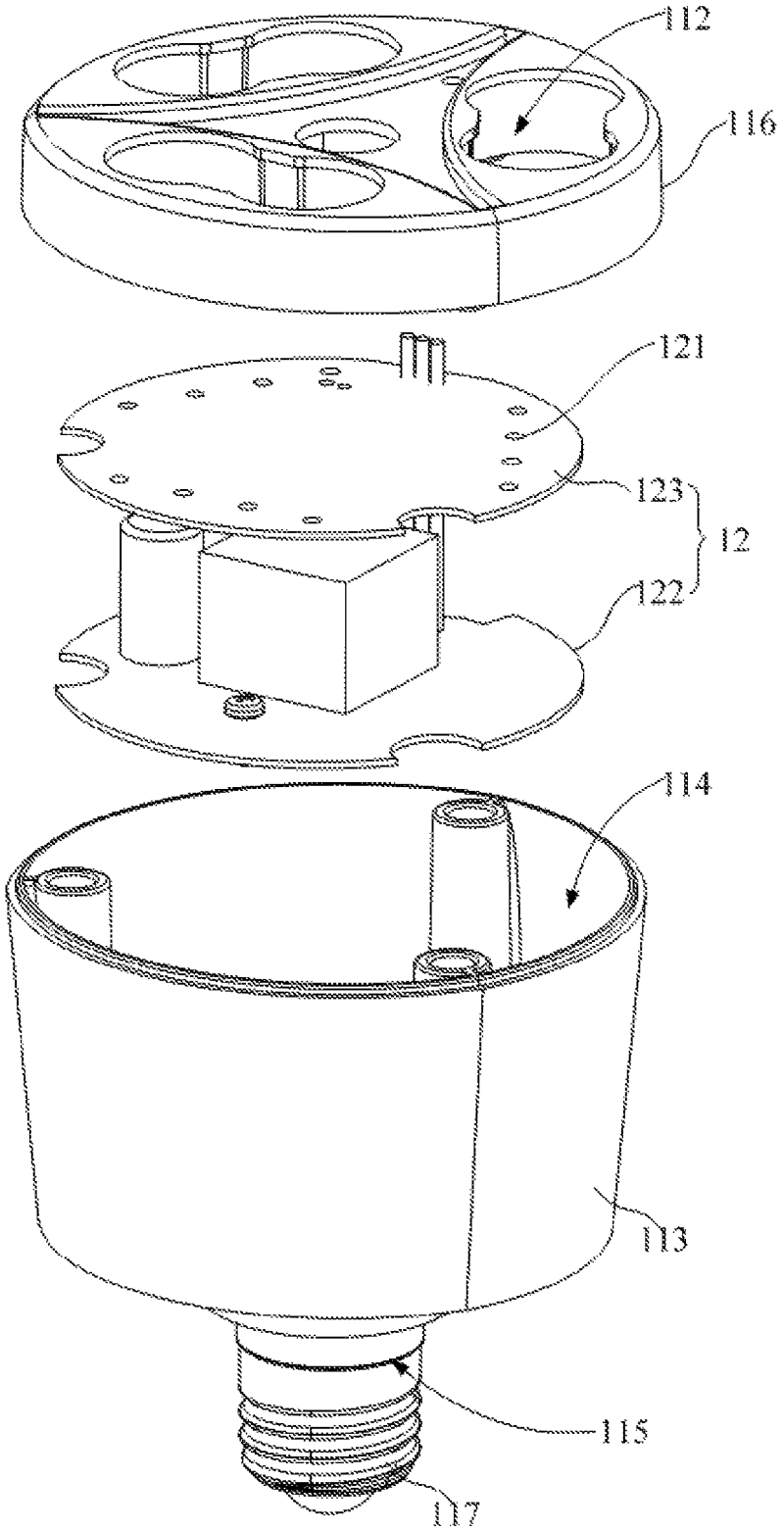
FIG. 5 is a schematic diagram showing the structure of base in FIG. 1.
Figure 6:
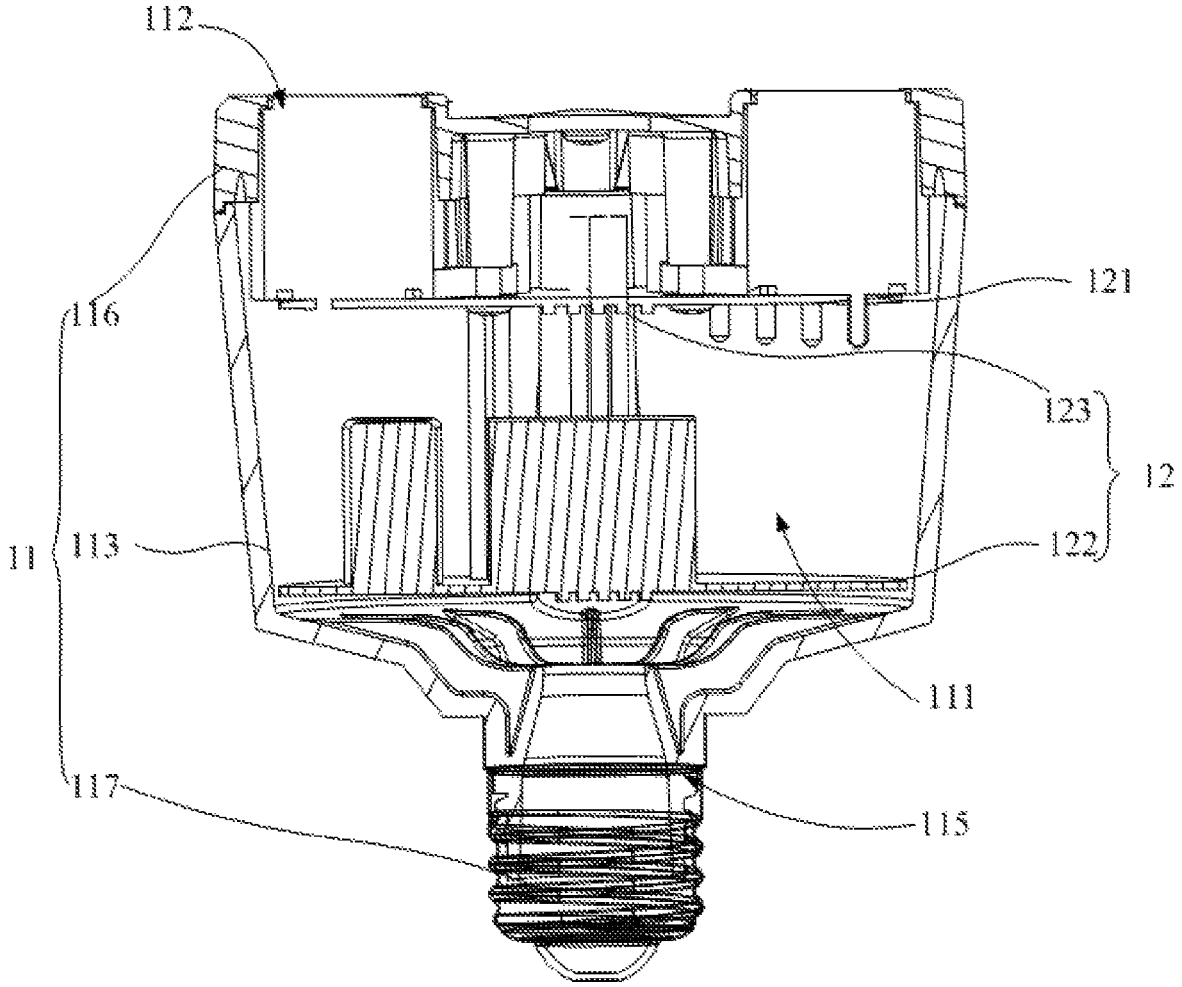
FIG. 6 is a schematic diagram showing the cross-sectional structure of base in FIG. 1.

This utility model provides a reflex lamp housing connecting luminous module 4, providing luminous module 4 with power and also protecting luminous module 4. Refer to FIG. 1, it is a schematic diagram showing the structure of an embodiment of reflex lamp housing of this utility model; Refer to FIG. 2, it is a schematic diagram showing the structure of another embodiment of reflex lamp housing in FIG. 1; Refer to FIG. 3, it is a schematic diagram showing the structure of support plate 5 in FIG. 2; Refer to FIG. 4, it is a schematic diagram showing the structure of another embodiment of reflex lamp housing in FIG. 1; Refer to FIG. 5, it is a schematic diagram showing the structure of base 1 in FIG. 1; Refer to FIG. 6, it is a schematic diagram showing the cross-sectional structure of base 1 in FIG. 1;

In the Embodiment of the utility model, as shown in FIG. 1 and according to FIG. 2 and FIG. 3, the reflex lamp housing includes: base 1, reflex lamp housing 2 provided on base 1 and at least one protective lantern ring 3 provided around reflex lamp housing 2. Wherein, base 1 serving as a carrier is used for installing luminous module 4; in other words, luminous module 4 connects to power grid via base 1.

In one embodiment of the utility model, reflex lamp housing 2 is provided on base 1, the periphery of reflex lamp housing 2 is provided with several containing grooves 21, the inner wall of each of containing grooves 21 is provided as a reflective panel, containing groove 21 is used for containing luminous module 4 which connects to base 1; protective lantern ring 3 is provided around reflex lamp housing 2, and protective lantern ring 3 and base 1 are provided at intervals to form light access area 31.

In this embodiment, reflex lamp housing 2 is provided around base 1, the periphery of reflex lamp housing 2 is provided with several containing grooves 21, and the inner wall of each of containing grooves 21 is provided as a reflective panel; wherein, several luminous modules 4 are provided on base 1, connect to base 1 electrically and are contained in several containing grooves 21, base 1 is taken as the connection base 1 for connecting the power supply to supply power for several luminous modules 4 which radiates in several containing grooves 21. Understandably, by taking base 1 as the connection base 1 and providing reflex lamp housing 2 on base, reflex lamp housing 2 is above the surface of base 1, luminous module 4 is away from base 1, avoiding rays of light being impeded by base 1, and rays of light are gathered with reflex lamp housing 2 to improve the efficiency of illumination; in another aspect, rays of light are generated with several luminous modules 4 to enhance illumination of rays of light within the unit time and enhance the coverage of rays of light. In yet another aspect, at least one protective lantern ring 3 is provided around the reflex lamp housing 2, connection of the protective lantern ring 3 and the reflex lamp housing 2 improves the structural strength between the protective lantern ring 3 and the reflex lamp housing 2, and the protective lantern ring 3 and the luminous module 4 are provided at intervals, which protects the luminous modules to some extent, protects the luminous module 4 from collision of external articles and improves the service life of the reflex lamp housing.

Optionally, several luminous modules 4 are provided nearby the bottom wall of containing groove 21, so that rays of light generated by several luminous modules 4 are reflected to the environment and illumination is improved.

Optionally, luminous module 4 can be LED light bar or tube. Luminous module 4 can be used for lighting or generating ultraviolet rays.

Optionally, luminous module 4 can be UV fluorescent tube; or, luminous module 4 is UV LED lamp.

In one embodiment of this invention, luminous module 4 is UV fluorescent tube. The ultraviolet ray radiation efficiency of UV fluorescent tube is much higher than that of UV LED lamp, and the price of the former is cheaper.

Optionally, the power of UV fluorescent tube can be 60 W or 78 W; the power can be altered according to the actual working scene.

In one embodiment of this invention, reflex lamp housing 2 can be an aluminum alloy workpiece, on the surface of which several containing grooves 21 are formed through processing. Optionally, reflex lamp housing 2 in the sleeve shape can be formed in the way of extrusion molding, secondary processing can be carried out on the surface of reflex lamp housing 2 to form several containing grooves 21 which will be polished or plated to form reflective panels.

Optionally, reflex lamp housing 2 can be formed by assembling several aluminum alloy plates, for which there is no restriction.

Optionally, reflex lamp housing 2 can be made of plastic; that is, reflex lamp housing 2 and several containing grooves 21 are formed in the way of integral injection molding, and coating or electroplating is applied to the surface of plastic workpieces to form reflective panels.

In one embodiment of this invention, containing groove 21 can be of a sinking tank structure, that is, under the premise that containing groove 21 can reflect ultraviolet ray, the shape of the cross section of containing groove 21 is not restricted.

Optionally, the inner wall of containing groove 21 is in a cambered shape.

In one embodiment of the utility model, according to FIG. 2 and FIG. 4, the reflex lamp housing also comprises several protective lantern rings 3 provided around reflex lamp housing 2, and two neighboring protective lantern rings 3 are provided at intervals.

In this embodiment, several protective lantern rings 3 are provided along the length of reflex lamp housing 2, luminous module 4 is provided in containing groove 21 along the length of containing groove 21, several protective lantern rings 3 are applied to protect luminous module 4, protecting luminous module 4 from collision of external articles.

In one embodiment of the utility model, protective lantern ring 3 can be made of plastic or metal, which is not restricted under the premise that protective lantern ring 3 can be used for shielding UV module from collision of external articles.

When protective lantern ring 3 is made of plastic, protective lantern ring 3 can be made into an annular shape in the way of primary modeling or secondary modeling, and then protective lantern ring 3 is provided around reflex lamp housing 2; wherein, protective lantern ring 3 and reflex lamp housing 2 can be connected in the way of dead connection or dismountable connection, that is, protective lantern ring 3 can be made of elastic material, and the inner wall of protective lantern ring 3 and the periphery of reflex lamp housing 2 are against each other; or plastic protective lantern ring 3 connects around reflex lamp housing 2 in the way of secondary thermoplastic treatment; no restriction is given here under the premise that protective lantern ring 3 can be used for shielding UV module from collision of external articles.

When protective lantern ring 3 is made of metal, annular protective lantern ring 3 can be cut from one tube material, and protective lantern rings 3 are provided around reflex lamp housing 2. Wherein, protective lantern ring 3 and reflex lamp housing 2 can connect in the way of interference fit or through welding, which is not restricted under the premise that protective lantern ring 3 can be used for shielding UV module from collision of external articles.

In one embodiment of the utility model, protective lantern ring 3 and reflex lamp housing 2 are connected through welding.

In this embodiment, protective lantern ring 3 and reflex lamp housing 2 connect through welding to provide the overall structural strength of reflex lamp housing.

In one embodiment of the utility model, according to FIG. 2 and FIG. 4, the inner wall of containing groove 21 is in a cambered shape; that is, after rays of light arrives on the cambered surface, rays of light can be reflected by the cambered surface, ultraviolet rays can be reflected outward at a certain angle, and then light is reflected to the area which just faces containing groove 21.

In one embodiment of the utility model, the periphery of reflex lamp housing 2 is provided with three containing grooves 21; in this embodiment, three containing grooves 21 can respectively contain three luminous modules 4 which will send rays of light, realizing 360° lighting or sterilization around reflex lamp housing 2.

In one embodiment of this invention, reflex lamp housing 2 is made of aluminum alloy; aluminum alloy is of certain extensibility, so that it can be processed into reflex lamp housing 2 to improve the production efficiency; in another aspect, aluminum alloy is of strong heat conduction performance which can realize heat dissipation of luminous module 4.

In one embodiment of this invention, protective lantern ring 3 is made of aluminum alloy. aluminum alloy is of certain extensibility, so that it can be processed into protective lantern ring 3 to improve the production efficiency; in another aspect, aluminum alloy is of strong heat conduction performance which can realize heat dissipation of luminous module 4.

In one embodiment of this invention, reflex lamp housing 2 is of a sleeve structure; in this embodiment, it can be deemed as that reflex lamp housing 2 is of a sleeve structure out of one tube material through cutting, several containing grooves 21 are formed on the circumferential direction of reflex lamp housing 2 in the way of extrusion molding. In other words, the area of all the cross sections of reflex lamp housing 2 is the same, protecting luminous module 4 from damage of the convex inner wall of containing groove 21 and improving the installation stability of luminous module 4.

In one embodiment of this invention, protective lantern ring 3 is of a sleeve structure. In this embodiment, it can be considered that protective lantern ring 3 is an annular structure out of a tube material through cutting. Several protective lantern rings 3 can be out of one tube material through cutting, simplifying the production process of protective lantern ring 3, improving the reflex lamp housing production efficiency and reducing the cost of components.

In one embodiment of the utility model, the reflex lamp housing also comprises support plate 5 provided on one end of reflex lamp housing 2 away from base 1 and provided with locating hole 51 corresponding to each of containing grooves 21; the inner wall of locating hole 51 and the outer wall of luminous module 4 are against each other.

In this embodiment, after one end of luminous module 4 connects to base 1, the other end of luminous module 4 will suspend. To enhance the connection strength between luminous module 4 and base 1 as well as luminous module 4 and reflex lamp housing 2, a structure of support plate 5 is installed on one end of reflex lamp housing 2 away from base 1. Support plate 5 is provided with locating hole 51 corresponding to luminous module 4. Partial luminous module 4 passes through locating hole 51 to position both ends of luminous module 4 and improve the installation stability of luminous module 4.

Optionally, support plate 5 and reflex lamp housing 2 can be connected with bolts or screws.

In one embodiment of the utility model, according to FIG. 2 and FIG. 3, the reflex lamp housing also comprises several elastic washers 6, each of the elastic washers 6 is provided in one locating hole 51, that is, elastic washer 6 is an annular structure and is provided around the inner wall of locating hole 51.

In this embodiment, elastic washer 6 is provided around the inner wall of locating hole 51, elastic washer 6 serves as a buffer medium to protect luminous module 4 from damage; wherein, elastic washer 6 is made of elastic materials, such as plastic or silica gel.

In one embodiment of the utility model, according to FIG. 5 and FIG. 6, base 1 comprises: lamp cap 11 and circuit component 12 provided on lamp cap 11; wherein, lamp cap 11 is provided with input end 117 for connecting circuit component 12, connecting the base electrically and accessing the power grid by working with the base.

Specifically, lamp cap 11 is provided with installation cavity 111 and several offsetting holes 112 connecting installation cavity 111, and each of offsetting holes 112 is provided corresponding to each of containing grooves 21; circuit component 12 is provided in installation cavity 111, connects to lamp cap 11 electrically, circuit component 12 is provided with connection terminal 121 corresponding to each of offsetting holes 112, and connection end 121 is used for electrical connection with luminous module 4.

In this embodiment, when luminous module 4 is provided on base 1, one end of luminous module 4 can be located into offsetting hole 112, that is, one end of luminous module 4 and the inner wall of offsetting hole 112 are against each other, realizing location of luminous module 4.

In another aspect, one end of luminous module 4 can also be convex, when luminous module 4 passes through offsetting hole 112, the convex part is against the inner wall of installation cavity 111, realizing further location of luminous module 4.

In one embodiment of the utility model, according to FIG. 5 and FIG. 6, lamp cap 11 comprises:

bottom shell 113 provided with tank 114 and mounting opening 115 for connecting the bottom wall of tank 114;

upper cover 116 connecting to bottom shell 113, covering tank opening of tank 114 to form installation cavity 111 in the way of enclosure, and provided with several offsetting holes 112; and input end 117 connecting bottom shell 113, sealing mounting opening 115, connecting circuit component 12 electrically.

In this embodiment, upper cover 116 and bottom shell 113 connect and enclose to form installation cavity 111, so that upper cover 116 can be removed from bottom shell 113 for maintenance of circuit component 12.

According to FIG. 5 and FIG. 6, circuit component 12 comprises the first circuit board 122 and the second circuit board 123 contained in installation cavity 111, wherein, the first circuit board 122 connect to the second circuit board 123, the first circuit board 122 connects the inner wall of tank 114, the second circuit board 123 is provided on one side of upper cover 116 facing bottom shell 113, the second circuit board 123 is provided with connection end 121, and the first circuit board 122 is provided with a power adapter.

In this embodiment, in installation cavity 111 of lamp housing, the first circuit board 122 and the second circuit board 123 connecting to the first circuit board 122 are provided, the first circuit board 122 is provided with a power adapter, and the second circuit board 123 is provided with connection end 121; understandably, the first circuit board 122 is provided with a power adapter, and the second circuit board 123 is provided with connection end 121, so that the power adapter and connection end 121 can be provided independently, the first circuit board 122 and the second circuit board 123 which are provided independently divide several functions of circuit component 12 effective to simplify functions of one circuit board, lower production difficulties and improve the production efficiency; meanwhile, disassembly and assembly of the first circuit board 122 and the second circuit board 123 can be carried out independently, improving the maintainability of circuit component 12. In another aspect, the first circuit board 122 and the second circuit board 123 are provided at intervals, leaving clearance between the first circuit board 122 and the second circuit board 123 to enhance the heat dissipation effect. In yet another aspect, the first circuit board 122 is on one side of the second circuit board 123 relatively, making the projection area of the first circuit board 122 and that of the second circuit board 123 overlap to reduce the transverse occupation area of base 1 and improve the structure compactness of base 1.

Optionally, luminous module 4 can be UV fluorescent tube; UV fluorescent tube is provided with several metal pins, enabling the UV fluorescent tube to be plugged into connection end 121 of the second circuit board 123 via several metal pins. Wherein, connection end 121 is provided with several metal jacks, that is, the second circuit board 123 is provided with several through-holes whose inner walls are provided with metal coating.

In another aspect, luminous module 4 can be LED light bar, one end of LED light bar is provided with a plug, connection end 121 of the second circuit board 123 can be socket, and the plug and the socket connect electrically to realize illumination of LED light bar.

This utility model also provides a modular lamp which comprises several luminous modules 4 and reflex lamp housing. See the specific structure of the reflex lamp housing in the above embodiment. Since the modular lamp adopts all the technical solutions of all the afore the embodiments, at least the modular lamp can achieve all the beneficial effects of all the technical solutions of afore the embodiments, so unnecessary details will not be given here. Wherein, several the luminous modules 4 are contained in several containing grooves 21 of the reflex lamp housing, and several the luminous modules 4 and base 1 of the reflex lamp housing electrically.

In one embodiment of the utility model, the luminous module 4 is UV fluorescent tube or LED light bar. In other words, in this solution, luminous module 4 can be UV fluorescent tube or LED light bar. Accessed luminous modules are adjusted according to practical application to improve the adaptability.

Understandably, the luminous module 4 can connect to base 1, that is, luminous module 4 passes through offsetting hole 112 and is against the inner wall of offsetting hole 112.

In another aspect, the luminous module 4 can connect to reflex lamp housing 2, that is, reflex lamp housing 2 can be provided with locating components (not shown in figures), luminous module 4 is contained in containing groove 21 and partially clamped by a locating component. Wherein, the fastening part can be a locating buckle.

The description is only the preferred embodiment of the utility model, and it is not for this reason that the patent scope of the utility model is limited. Any equivalent structural transformation made by using the description of the utility model and the drawing, or direct/indirect application in other related innovation technical fields under the inventive concept of the utility model, is included in the patent protection scope of the utility model.

What is claimed is:

1. A reflex lamp housing which comprising:

base;

a reflex lamp housing provided on the base, a periphery of the reflex lamp housing provided with several containing grooves, the inner wall of each of the containing grooves provided as a reflective panel, the containing groove used for containing luminous module connecting to the base electrically;

at least one protective lantern ring provided around the reflex lamp housing and provided at intervals with the base to form a light access area, wherein the reflex lamp housing also comprises a support plate provided on one end of the reflex lamp housing away from the base and provided with a locating hole corresponding to each of the containing grooves; and the inner wall of the locating holes and the outer wall of luminous module are against each other.

2. The reflex lamp housing as claimed in claim 1, wherein the reflex lamp housing further comprises several protective lantern rings provided around the reflex lamp housing, and two neighboring of the protective lantern rings are provided at intervals.

3. The reflex lamp housing as claimed in claim 2, wherein the protective lantern ring and the reflex lamp housing are connected by welding.

4. The reflex lamp housing as claimed in claim 1, wherein the inner wall of the containing grooves is in a cambered shape.

5. The reflex lamp housing as claimed in claim 1, wherein the reflex lamp housing further comprises several elastic washers, and each of the elastic washers is provided on the locating hole.

6. The reflex lamp housing as claimed in claim 1, wherein the base comprises:

a lamp cap provided with an installation cavity and several offsetting holes connecting the installation cavity, wherein each of the offsetting holes is provided corresponding to each of the containing grooves; and circuit components provided in the installation cavity and connecting to the lamp cap, wherein the circuit components are provided with a connection end corresponding to each of the offsetting holes and the connection end is used for electric connection with luminous module.

7. The reflex lamp housing as claimed in claim 6, wherein the lamp cap comprises:

a bottom shell provided with a tank and a mounting opening for connecting a bottom wall of the tank;

an upper cover connecting to the bottom shell, covering an opening of the tank to form the installation cavity, and provided with the several offsetting holes; and input end connecting to the bottom shell, sealing the mounting opening, and connecting to the circuit components electrically.

8. A modular lamp, comprising several luminous modules and the reflex lamp housings of claim 1, wherein several of the luminous modules are provided in several containing grooves of the reflex lamp housing, and several of the luminous modules connect to the base of the reflex lamp housing electrically.

9. The modular lamp as claimed in claim 8, wherein the luminous module is UV fluorescent tube or LED light bar.

10. The reflex lamp housing of claim 1, wherein the periphery of the reflex lamp housing are provided with three of the containing grooves.

11. The reflex lamp housing of claim 1, wherein the reflex lamp housing is made of aluminum alloy.

12. The reflex lamp housing of claim 1, wherein the protective lantern ring is made of aluminum alloy.

13. The reflex lamp housing of claim 1, wherein one or more of the reflex lamp housing and the protective lantern ring are of a sleeve structure.

* * * * *